US009198276B2

(12) United States Patent
Fox

(10) Patent No.: US 9,198,276 B2
(45) Date of Patent: Nov. 24, 2015

(54) SOFT-START ADAPTER FOR AC HEATED ELECTRON GUN

(71) Applicant: Varian Medical Systems, Inc., Palo Alot, CA (US)

(72) Inventor: Timothy R. Fox, Chicago, IL (US)

(73) Assignee: Varian Medical Systems, Inc., Palo Alto, CA (US)

( * ) Notice: Subject to any disclaimer, the term of this patent is extended or adjusted under 35 U.S.C. 154(b) by 20 days.

(21) Appl. No.: 13/831,654

(22) Filed: Mar. 15, 2013

(65) Prior Publication Data

US 2014/0265847 A1 Sep. 18, 2014

(51) Int. Cl.
*H05B 41/16* (2006.01)
*H05H 7/08* (2006.01)

(52) U.S. Cl.
CPC ..... *H05H 7/08* (2013.01); *H05H 2007/084* (2013.01)

(58) Field of Classification Search
USPC ..... 315/94, 105, 209 R, 219, 276, 279, 287, 315/291, 326
See application file for complete search history.

(56) References Cited

U.S. PATENT DOCUMENTS 3,400,207 A * 9/1968 Anderson ..... 373/12
3,781,598 A * 12/1973 Widmayer ..... 315/107
4,728,866 A * 3/1988 Capewell et al. ..... 315/224
5,537,005 A * 7/1996 Goebel et al. ..... 315/111.81

* cited by examiner

*Primary Examiner* — Thuy Vinh Tran
(74) *Attorney, Agent, or Firm* — Patent Law Group LLP; David C. Hsia

(57) ABSTRACT

A circuit to power an electron source includes a filament transformer comprising a primary side and a secondary side, a high-voltage transformer coupled to the filament transformer and the electron source, and an alternating current (AC) current limiter coupled in series with the primary side or the secondary side of the filament transformer. The AC current limiter includes a diode bridge and a current-limiting device in the diode bridge.

23 Claims, 4 Drawing Sheets

SOFT-START ADAPTER FOR AC HEATED ELECTRON GUN

BACKGROUND

A radiotherapy treatment system typically includes a gantry that positions a radiation delivery apparatus, such as a linear accelerator ("linac"), around a patient during radiotherapy. A linac may include an electron gun with an electron source that emits electrons by thermionic emission. The electron source may be a cathode located in a vacuum tube. A directly-heated cathode may be referred to as a "filament" and an indirectly-heated cathode may be referred to as a "cathode heater."

FIG. 1 shows a conventional circuit 100 for powering an electron source. A variable transformer 102 controls the voltage applied to the primary side of a filament transformer 104. Filament transformer 104 has the appropriate voltage ratio to change the output of variable transformer 102 to the voltage required for an electron source 106, such as a filament, to emit electrons toward a grounded anode 107. A pulse transformer 108 has a primary winding 110 coupled to a pulse generator 112, and a pair of unity-coupled secondary (or "heater") windings 114 and 116 that feed the high-voltage to filament 106. The difference in the voltages at the "right" two terminals of unity-coupled secondary windings 114 and 116 is equal the difference at the "left" two terminals of the unity-coupled secondary windings 114 and 116 in FIG. 1 (e.g., 6 volts at 60 hertz). However, the mean voltage at the two terminals on the right will include a pulse waveform coupled from the pulse voltage in primary winding 110 (e.g., tens of kilovolts pulse amplitude and negative polarity.)

BRIEF DESCRIPTION OF THE DRAWINGS

In the drawings.

Use of the same reference numbers in different figures indicates similar or identical elements.

DETAILED DESCRIPTION OF THE INVENTION

Figure 1:
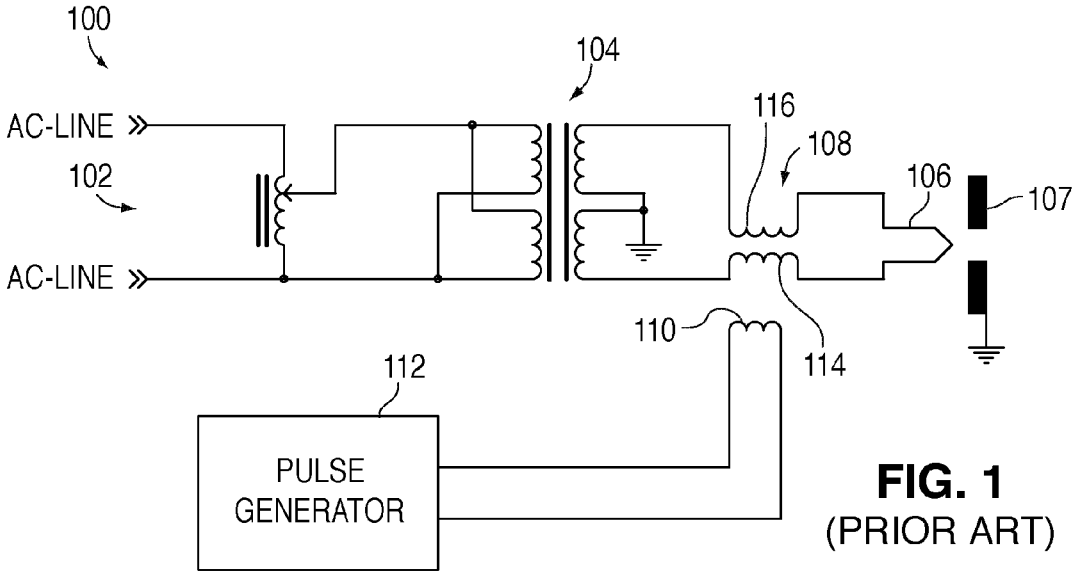
FIG. 1 (PRIOR ART)
FIG. 1 shows a conventional circuit for powering a cathode heater in a linac.

Referring to FIG. 1, electron source 106 typically has a high inrush current when it is first turned on. The high inrush current is caused by the low, "cold" resistance when the operating voltage is first applied while the cathode is still at room temperature. After power is applied, the heater temperature increases to the normal operating temperature. During this temperature increase, the heater resistance increases substantially, exhibiting a positive temperature coefficient, and the current falls to the normal operating level that is lower than the inrush current. Unfortunately the high inrush current can stress cathode heater 10 and associated wiring, including the feedthrough conductors that connect through the wall of the vacuum tube, which possibly causes premature electrical failure (e.g., open circuit).

Figure 2:
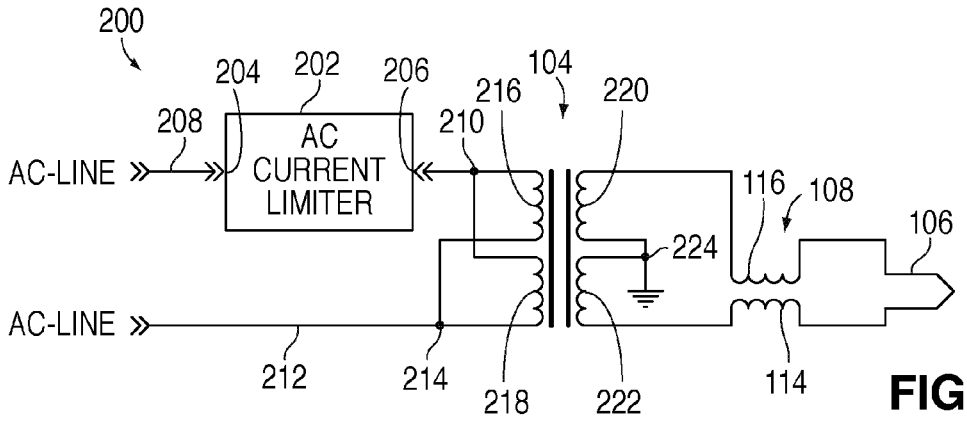
FIG. 2 shows a circuit for powering a cathode heater with an alternating current (AC) current limiter in series with a high-voltage primary side of a filament transformer in one example of the present disclosure.

FIG. 2 shows a circuit 200 for powering electron source 106 with an alternating current (AC) current limiter 202 coupled in series with a high-voltage primary side of filament transformer 104 in one example of the present disclosure. Although electron source 106 is illustrated as a filament, alternatively it may be a cathode heater. Current limiter 202 may be a two-terminal network. Current limiter 202 has a first terminal 204 connected to an AC line 208, and a second terminal 206 connected to a node 210. An AC line 212 (e.g., neutral) is connected to a node 214. Primary windings 216 and 218 of filament transformer 104 are connected in parallel to nodes 210 and 214.

Secondary windings 220 and 222 of filament transformer 104 are connected in series and grounded at their connection 224. Secondary winding 222 of filament transformer 104 is next connected in series to secondary winding 114 of pulse transformer 108 (shown partially), which is connected in series to filament 106. Filament 106 is next connected in series to secondary winding 116 of pulse transformer 108, which is connected in series to secondary winding 220 of filament transformer 104. Unity-coupled windings 114 and 116 are two closely spaced, parallel windings.

Figure 3:
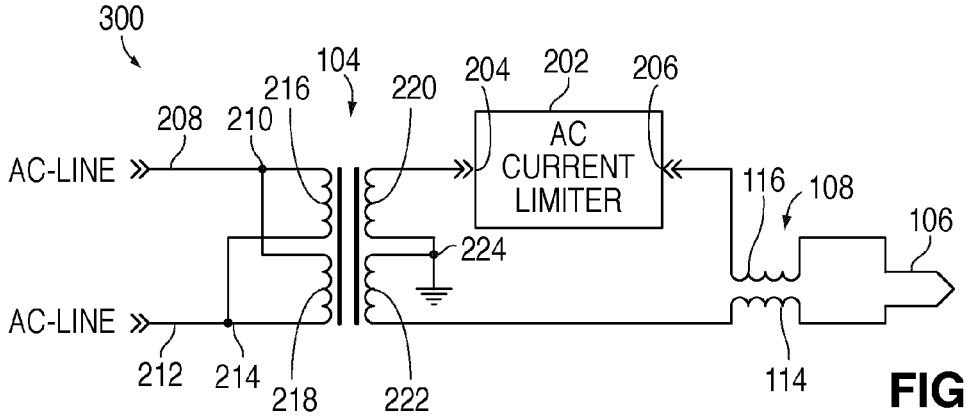
FIG. 3 shows a circuit for powering a cathode heater with an AC current limiter in series with a low-voltage secondary side of a filament transformer in one example of the present disclosure.

FIG. 3 shows a circuit 300 for powering filament 106 with AC current limiter 202 coupled in series with a low-voltage secondary side of filament transformer 104 in one example of the present disclosure. Unlike circuit 300, AC line 208 is now connected to node 210, and AC current limiter 202 has its terminals 204 and 206 connected to secondary winding 220 of filament transformer 104 and winding 116 of pulse transformer 108 (shown partially), respectively.

Figure 4A:
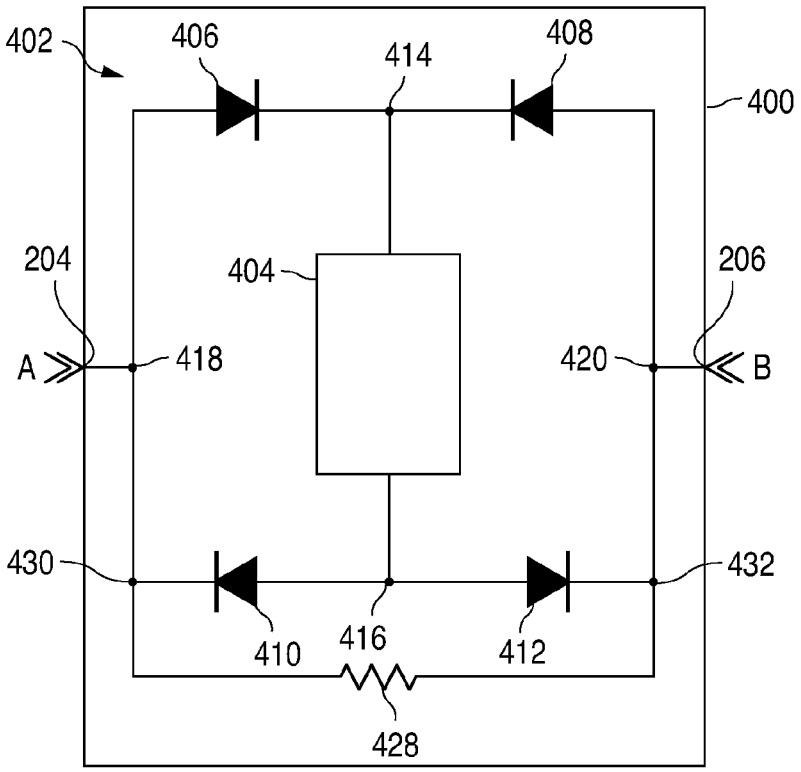
FIG. 4A shows an AC current limiter of FIG. 3 in one example of the present disclosure.

FIG. 4A shows an AC current limiter 400 in one example of the present disclosure. AC current limiter 400 may be used as AC current limiter 202 in FIGS. 2 and 3. AC current limiter 400 includes a diode bridge 402 and a current-limiting device 404 in diode bridge 402.

In one example, diode bridge 402 is a full-wave diode bridge having a first diode 406, a second diode 408, a third diode 410, and a fourth diode 412. Diodes 406, 408, 410, and 412 may be silicon devices for use at high voltage, or Shottky-junction diodes (with lower forward-bias voltage drop) for use at high current. Full-wave diode bridge 402 is configured so cathodes of first diode 406 and second diode 408 are connected at a first junction 414, anodes of third diode 410 and fourth diode 412 are connected at a second junction 416, the anode of first diode 406 and the cathode of third diode 410 are coupled at a third junction 418, and the anode of second diode 408 and the cathode of fourth diode 412 are coupled at a fourth junction 420. Current-limiting device 404 is connected between first junction 414 and second junction 416. Junctions 418 and 420 of full-wave diode bridge 402 are connected to terminals 204 and 206 of AC current limiter 400, respectively.

AC current limiter 400 further includes a resistor 428 coupled in parallel with diode bridge 402 between terminals 204 and 206. Resistor 428 may be coupled to terminal 204 via a node 430 in the path from the cathode of third diode 410 to junction 418, and resistor 428 may be coupled to terminal 206 via a node 432 in the path from the cathode of fourth diode 412 to junction 420.

Figure 4B:
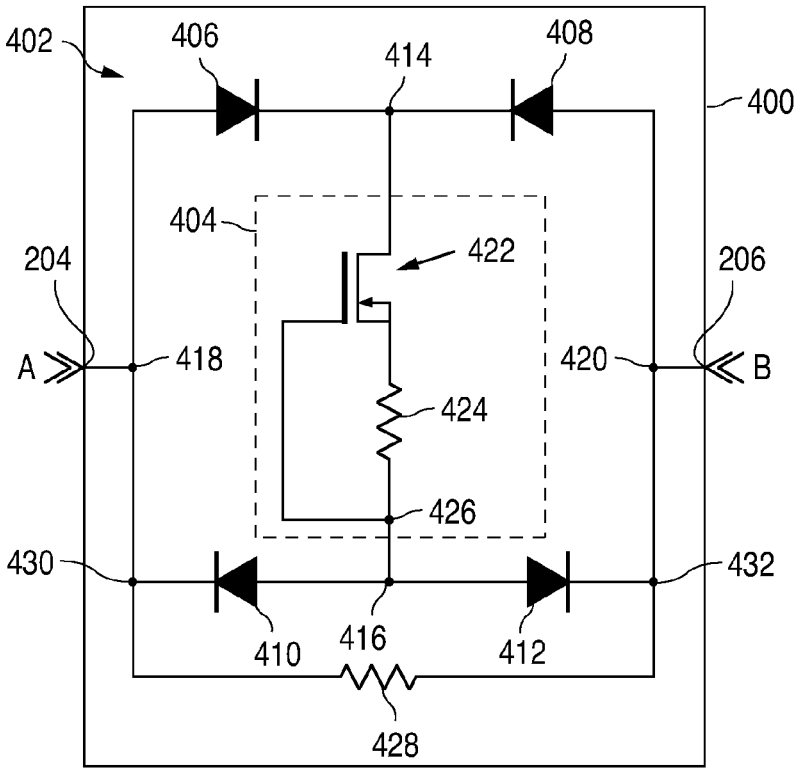
FIG. 4B shows an AC current limiter of FIG. 3 in another example of the present disclosure.

FIG. 4B shows AC current limiter 400 in another example of the present disclosure. In this example, current-limiting device 404 includes a field effect transistor (FET) 422, such as an N-channel depletion-mode metal oxide semiconductor field effect transistor (MOSFET). "Depletion" means that MOSFET 422 conducts with zero gate-source bias voltage, and a desired drain current is obtained with a negative gate-source bias voltage. N-channel depletion-mode MOSFET 422 has a gate, a drain, and a source. The drain of N-channel depletion-mode MOSFET 422 is connected to first junction 414 of full-wave diode bridge 402, and the source is coupled to second junction 416 of full-wave diode bridge 402.

Current-limiting device 404 further includes a source resistor 424. A first terminal of source resistor 424 is connected to the source of N-channel depletion-mode MOSFET 422, and a second terminal is coupled to junction 416 of full-wave diode bridge 402. The second terminal of source resistor 424 is also coupled to the gate of N-channel depletion-mode MOSFET 422, e.g., via a node 426 in the path between source resistor 424 and the anodes of diodes 410 and 412.

Figure 5:
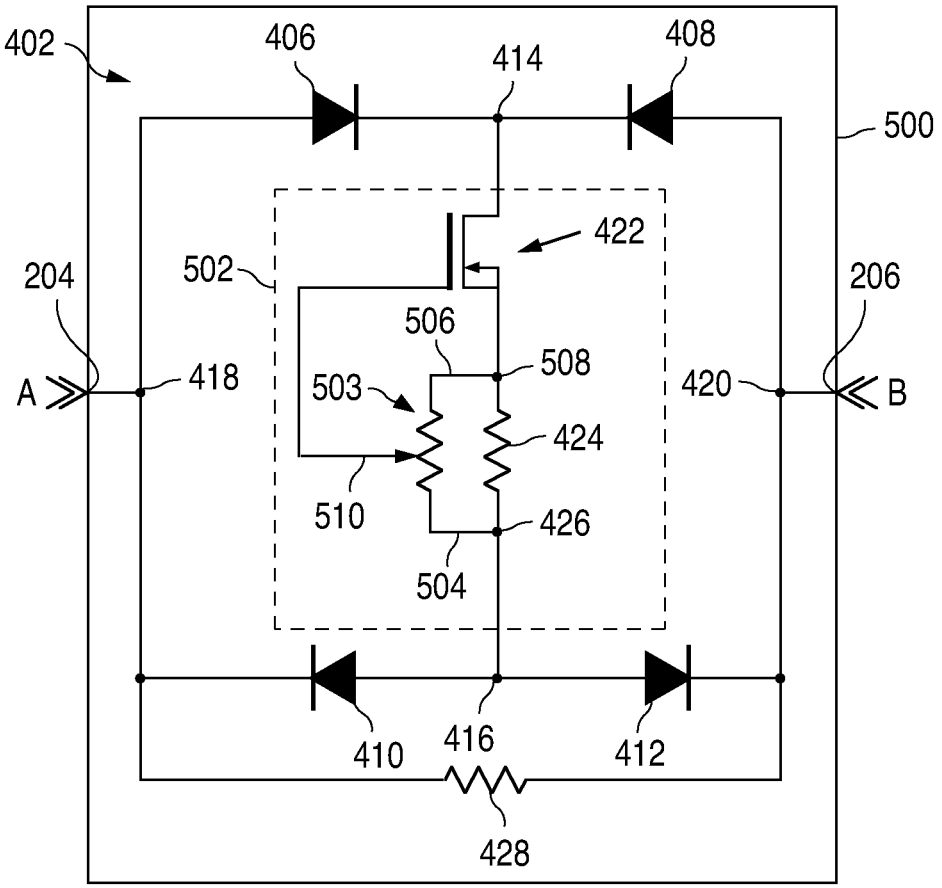
FIG. 5 shows an AC current limiter of FIG. 3 in another example of the present disclosure.

FIG. 5 shows an AC current limiter 500 in one example of the present disclosure. AC current limiter 500 may be used as AC current limiter 202 in FIGS. 2 and 3. AC current limiter 500 is similar to AC current limiter 400 (FIG. 4B) but a current limiting device 502 replaces current limiting device 404 (FIG. 4B). Current limiting device 502 is similar to current limiting device 404 but includes a potentiometer 503 coupled across source resistor 424. Potentiometer 503 has a first terminal 504 coupled second junction 416, e.g., via node 426. Potentiometer 503 has a second terminal 506 coupled to the source of N-channel depletion-mode MOSFET 422, e.g., via a node 508 in the path between the source of N-channel depletion-mode MOSFET 422 and source resistor 424. Potentiometer 503 has a wiper terminal 510 connected to the gate of N-channel depletion-mode MOSFET 422.

In operation, the voltage on the gate of N-channel depletion-mode MOSFET 422 is negative with respect to the source of N-channel depletion-mode MOSFET 422 because the drain current flows through source resistor 424. With N-channel depletion-mode MOSFET 422 in "saturation" (high drain-source voltage), the drain current is limited to a unique value that, when flowing through source resistor 424, produces a gate-source voltage that corresponds to that current. If the resistance of source resistor 424 is zero (0), then the drain current is equal to the zero-bias current for N-channel depletion-mode MOSFET 422, which is a data-sheet parameter with some variation form unit to unit. In AC current limiter 500, potentiometer 503 allows the limit on the drain current to be adjusted by applying a fraction of the voltage through source resistor 424 to the gate of N-channel depletion-mode MOSFET 422. The adjustment of the current-limit value allows AC current limiter 500 to compensate for variation in gate-source threshold voltage between individual devices of the same part.

While a MOSFET channel can conduct in both directions (from drain to source and from source to drain), commercially-available power MOSFET devices typically include a diode in the package from the drain to the source. Such a diode "shorts out" the MOSFET from drain to source when the source is positive with respect to the drain. To avoid this current path, full-wave diode bridge 402 forces the current to flow through N-channel depletion-mode MOSFET 422 only from drain to source. When first terminal 204 is positive with respect to second terminal 206, the current flows from first terminal 204 to second terminal 206 through first diode 406, N-channel depletion-mode MOSFET 422, and fourth diode 412. When second terminal 206 is positive with respect to first terminal 204, the current flows from second terminal 206 to first terminal 204 through second diode 408, N-channel depletion-mode MOSFET 422, and third diode 410. N-channel depletion-mode MOSFET 422 may be mounted on a heat sink as it may get hot during the initial turn-on (approximately 2 to 10 seconds) but may run relatively cool during normal operation at equilibrium for an extended time. At equilibrium, MOSFET 422 is in its "ON" condition with relatively low resistance and does not dissipate very much power.

Resistor 428 prevents AC current limiter 202 from going to high resistance when the voltage from terminal 204 to 206 is low compared with the turn-on voltage of diodes 406, 408, 410, and 412.

When diodes 406, 408, 410, and 412 have substantially similar properties (e.g., voltage drop versus current), there should be no or little difference in the absolute value of the voltage drop across terminals 204 and 206 versus the absolute value of the current for the positive and negative swings of the voltage. Even though the AC current limiter is non-linear, this symmetry (a mathematically odd function) implies that there is no added DC component to the current when adding AC current limiter 202 to the original transformer circuit 100, or equivalently that there is no DC component to the voltage across AC current limiter 202 when driven by AC.

When AC current limiter 202 is connected to the high-voltage primary side of filament transformer 104, any small DC component would not pass through the step-down from the primary to the secondary side so there will be no DC component on the voltage across filament 106.

Figure 6:
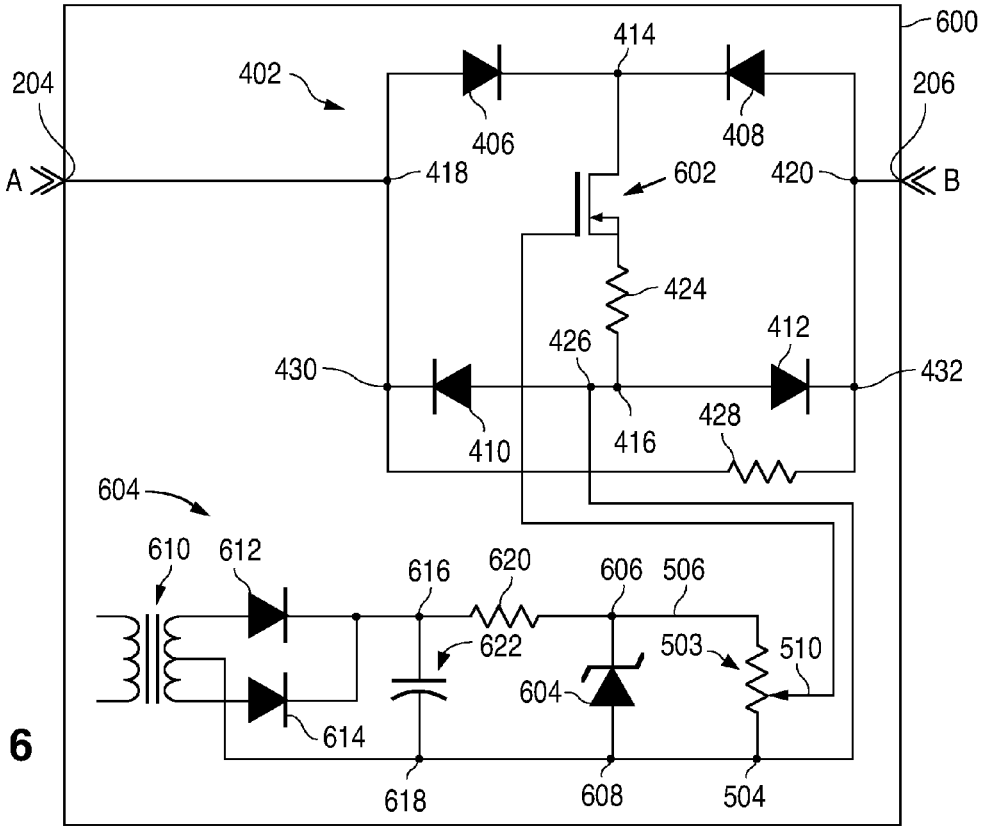
FIG. 6 shows an AC current limiter of FIG. 3 in an additional example of the present disclosure.

FIG. 6 shows an AC current limiter 600 in one example of the present disclosure. AC current limiter 600 may be used as AC current limiter 202 in FIGS. 2 and 3. AC current limiter 600 is similar to AC current limiter 500 (FIG. 5) but for the following. AC current limiter 600 uses an N-channel enhancement-mode MOSFET 602 in place of N-channel depletion-mode MOSFET 422 (FIGS. 4 and 5). "Enhancement" means that MOSFET 602 does not conduct when the gate-source bias voltage is zero or negative, and that a positive gate-source voltage is needed for substantial conduction between drain and source. To obtain the required positive gate bias on N-channel enhancement-mode MOSFET 602, AC current limiter 600 further requires a DC power supply so AC current limiter 600 is not a true two-terminal network. AC current limiter 600 includes a rectifier 604 for that DC supply. Potentiometer 503 now has its second terminal connected to a first terminal of rectifier 604 and its second terminal further connected to a second terminal 608 of rectifier 604.

In one example, rectifier 604 is a full-wave rectifier. Full-wave rectifier 604 includes a low-voltage, center-tapped transformer 610 and diodes 612 and 614 coupled anode-to-anode by the secondary winding of transformer 610. The cathodes of diodes 612 and 614 are coupled to a node 616. The center tap transformer 610 is connected to a node 618. Full-wave rectifier 604 may further include an RC filter to smooth out the output voltage. The RC filter includes a resistor 620 and a capacitor 622. Resistor 620 is connected between nodes 616 and node 606, and capacitor 622 is connected between nodes 616 and 618. Full-wave rectifier 604 may further include a Zener diode 624 to regulate the output voltage. Zener diode 624 is connected between nodes 606 and 608. Note that the isolated secondary side of transformer 610 is used to float that the bias voltage to the gate of N-channel enhancement-mode MOSFET 602. Other types of rectifier circuit, such as full-wave bridge or half-wave rectifier can be used instead of the full-wave rectifier circuit shown here.

AC current limiter 202 offers many advantages over the prior art. In AC current limiter 202, current-limiting device 422 or 602 is surrounded by a full-wave diode bridge 402, which ensures that the DC component of the output waveform is negligible as long as the difference between the forward-voltage characteristics of diodes 406, 408, 410, and 412 is small. AC current limiter 202 exploits the basic operation of a FET, which is that drain current is only a weak function of the drain-source voltage when that voltage is above the "pinch-off" voltage that defines the boundary between linear and saturation regions of the FET. At lower voltages, the FET appears closer to a small resistance. The saturation current and the ON resistance of the FET is a function of gate-source control voltage. Using source feedback (i.e., source resistor 424 in series with the source of MOSFET 422 or 602) reduces the dependence of the actual limiting current on the individual MOSFET. In other words, source resistor 424 gives the appropriate negative feedback with a negative gate-source bias voltage for constant-current operation.

While a fixed source resistor 424 may be sufficient, a low-power variable resistor implemented with potentiometer 503 allows for adjustment of the source feedback.

As described above, AC current limiter 202 limits the inrush current to a safe value when the voltage across filament 106 is less than the operating value. When the voltage across filament 106 is at operating value, AC current limiter 202 appears as a relative small series resistance. This allows AC current limiter 202 to be added in series with the overall circuit, such as in series with the high-voltage primary side or the low-voltage secondary side of filament transformer 104 as shown in FIGS. 2 and 3.

Figure 7:
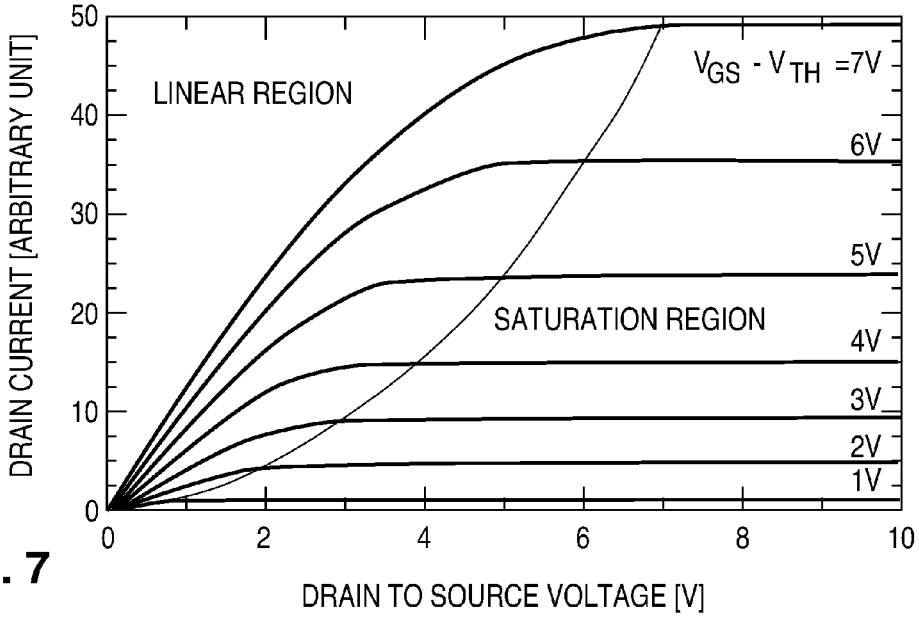
FIG. 7 shows a family of curves for an N-channel metal oxide semiconductor field effect transistor (MOSFET) where each curve illustrates drain current versus drain-source voltage for one value of gain-source voltage compared to a threshold voltage.

Typical design parameters may set the current limit value to less than twice the operating peak current value at the appropriate side of filament transformer 104, which is less than the normal inrush current with a cold filament 106. To adjust the peak current value before installing in the system, using the circuit of FIG. 5, a DC voltage can be applied to terminals 204 and 206 of AC current limiter 500, in either polarity, and potentiometer 503 adjusted to obtain the desired current value as measured on a DC current meter. When the voltage across filament 106 approaches the operating value, the drain-source voltage on MOSFET 422 or 602 falls below pinch-off, and the device's operating mode changes from constant-current in the saturation region to approximately constant-resistance in the "linear" or "triode" region at a relatively low ON resistance as shown in FIG. 7. With respect to the entire circuit, this constant-resistance behavior may be considered "saturation" or a "passive" state of the entire circuit (but not MOSFET 422 or 602).

Various other adaptations and combinations of features of the examples disclosed are within the scope of the invention. For example, appropriate diodes, resistors, and capacitors are selected based on application. Although filament transformer 104 is shown to have multiple windings on the primary and the secondary sides, it may be made with only one winding on the primary and/or secondary side. Numerous examples are encompassed by the following claims.

The invention claimed is:

1. A circuit to power an electron source, comprising:

a filament transformer comprising a primary side and a secondary side;

a pulse transformer coupled to the filament transformer and the electron source; and an alternating current (AC) limiter coupled in series with the primary side or the secondary side of the filament transformer, the AC limiter comprising a two-terminal network including:

a diode bridge; and a current-limiting device in the diode bridge, the current-limiting device including a depletion mode field effect transistor (FET).

2. The circuit of claim 1, wherein:

the diode bridge comprises:

a first diode, a second diode, a third diode, and a fourth diode;

a first junction between cathodes of the first and the second diodes;

a second junction between anodes of the third and the fourth diodes;

a third junction between the anode of the first diode and the cathode of the third diode; and a fourth junction between the anode of the second diode and the cathode of the fourth diode; and the current-limiting device is coupled between the first and the second junctions.

3. The circuit of claim 2, wherein the AC limiter further comprises a resistor coupled parallel with the diode bridge between two terminals of the AC limiter.

4. The circuit of claim 1, wherein the depletion mode FET comprises a gate, a drain, and a source, the drain being coupled to a first junction of the diode bridge, the source being coupled to a second junction of the diode bridge, and the gate being coupled to the source to limit a drain current of the depletion mode FET.

5. The circuit of claim 4, wherein:

the current-limiting device further includes a source resistor having:

a first resistor terminal coupled to the source of the depletion mode FET; and a second resistor terminal coupled to the second junction of the diode bridge;

the gate of the depletion-mode FET is coupled to the second resistor terminal of the source resistor to receive a feedback.

6. The circuit of claim 5, wherein:

the depletion mode FET comprises a depletion-mode metal oxide semiconductor field effect transistor (MOSFET).

7. The circuit of claim 5, wherein:

the depletion mode FET comprises a depletion-mode MOSFET; and the current-limiting device further includes a potentiometer, the potentiometer having:

a first potentiometer terminal coupled to the first resistor terminal of the source resistor;

a second potentiometer terminal coupled to the second resistor terminal of the source resistor; and a wiper terminal coupled to the gate of the depletion-mode MOSFET.

8. The circuit of claim 1, wherein:

the primary side of the filament transformer comprises primary coils coupled in parallel to AC lines; and the secondary side of the filament transformer comprises secondary coils coupled in series wherein a junction between the secondary coils is grounded.

9. The circuit of claim 1, wherein the pulse transformer comprises unity-coupled secondary windings coupled to the electron source.

10. A circuit to power an electron source, comprising:

a filament transformer comprising a primary side and a secondary side;

a pulse transformer coupled to the filament transformer and the electron source; and an alternating current (AC) limiter coupled in series with the primary side or the secondary side of the filament transformer, the AC limiter comprising:

a diode bridge;

a current-limiting device in the diode bridge, the current-limiting device comprising:

a field effect transistor (FET) comprising a gate, a drain, and a source, the drain being coupled to a first junction of the diode bridge;

a source resistor having a first resistor terminal and a second resistor terminal, the first resistor terminal being coupled to the source of the FET, the second resistor terminal being coupled to a second junction of the diode bridge; and a power supply coupled to the gate of the FET and the source resistor to provide a feedback to the FET based on a source voltage through the source resistor.

11. The circuit of claim 10, wherein the power supply comprises a rectifier including:

a center-tapped transformer;

two diodes coupled anode-to-anode by a secondary winding of the center-tapped transformer, wherein cathodes of the diodes are coupled to a first node and a center tap of center-tapped transformer is connected to a second node; and an RC filter comprising:

a resistor coupled between the first node and a first rectifier terminal;

a capacitor coupled between the first and the second nodes; and a Zener diode coupled between the first rectifier terminal and a second rectifier terminal.

12. The circuit of claim 11, wherein the current-limiting device further comprises a potentiometer comprising:

a first potentiometer terminal coupled to the first rectifier terminal of the rectifier;

a second potentiometer terminal coupled to the second resistor terminal of the source resistor and the second rectifier terminal of the rectifier; and a wiper terminal coupled to the gate of the FET.

13. The circuit of claim 10, wherein the feedback provides a forward-biased gate-source voltage and the FET comprises an enhancement-mode MOSFET.

14. A method to power an electron source, comprising:

providing an alternating current (AC) to a filament transformer;

using a diode bridge of an AC current limiter coupled in series with a primary side or a secondary side of the filament transformer to pass a periodic current in one direction through a depletion mode field effect transistor (FET) of the AC current limiter;

when a resistance of the electron source is at less than an operating level, creating a drain-to-source voltage that operates the depletion mode FET in a saturation region to limit a drain current of the depletion mode FET where the drain current of the depletion mode FET is a weak function of the drain-to-source voltage but a function of a gate-to-source voltage of the depletion mode FET; and when the resistance of the electron source is at or greater than the operating level, creating the drain-to-source voltage that operates the depletion mode FET in a linear region to provide a variable resistance where the drain current is a function of the drain-to-source voltage and the gate-to-source voltage.

15. The method of claim 14, wherein the diode bridge passes the periodic current in one direction through the depletion mode FET by:

in a positive swing of the AC when a first terminal connected to the diode bridge is positive with respect to a second terminal connected to the diode bridge, passing the periodic current from the first terminal to the second terminal through a first diode, the depletion mode FET, and a second diode; and in a negative swing of the AC when the second terminal connected to the diode bridge is positive with respect to the first terminal connected to the diode bridge, passing the periodic current from the second terminal to the first terminal through a third diode, the depletion mode FET, and a fourth diode, wherein the first, the second, the third, and the fourth diodes have similar properties so an AC voltage across the AC current limiter does not have a direct current (DC) component.

16. The method of claim 15, further comprising providing a resistor parallel with the diode bridge between the first and the second terminals to provide a bypass path when a voltage between the first and the second terminals is low relative to turn-on voltages of the first, the second, the third, and the fourth diodes in the diode bridge.

17. The method of claim 14, wherein limiting the drain current of the depletion mode FET comprises coupling a gate of the depletion mode FET to a source of the depletion mode FET, wherein a drain of the depletion mode FET is coupled to a first junction of the diode bridge and the source of the depletion mode FET is coupled to a second junction of the diode bridge.

18. The method of claim 17, wherein:

the depletion mode FET comprises a depletion-mode metal oxide semiconductor field effect transistor (MOSFET); and limiting the drain current of the depletion mode FET further comprises providing a gate voltage based on voltage across a source resistor in series with the source of the depletion-mode MOSFET.

19. The method of claim 17, wherein:

the depletion mode FET comprises a depletion-mode MOSFET; and limiting the drain current of the depletion mode FET further comprises:

providing a source resistor in series with the source of the MOSFET;

providing a potentiometer parallel to the source resistor, the potentiometer having a wiper terminal coupled to the gate of the depletion-mode MOSFET.

20. The method of claim 14, further comprising providing the AC through a pulse transformer to heat the electron source.

21. A method to power an electron source, comprising:

limiting an inrush current to the electron source by limiting an alternating current (AC) to a primary side of a filament transformer or from a secondary side of the filament transformer, wherein limiting an AC comprises:

applying a diode bridge to pass the AC through a field-effect transistor (FET) in positive and negative swings of the AC; and providing a source feedback to the FET, comprising:

providing a source resistor in series with the source of the FET; and providing a gate voltage to the gate of the FET based on a source voltage through the source resistor.

22. The method of claim 21, wherein the gate voltage provides a forward-biased gate-source voltage and the FET comprises an enhancement-mode MOSFET.

23. The method of claim 21, further comprising adjusting the gate voltage with a potentiometer.

* * * * *